US010069257B1

(12) United States Patent
Soubh et al.

(10) Patent No.: US 10,069,257 B1
(45) Date of Patent: Sep. 4, 2018

(54) INLINE COMPRESSION RF CONNECTOR

(71) Applicant: Carlisle Interconnect Technologies, Inc., Saint Augustine, FL (US)

(72) Inventors: Emad Soubh, Vancouver, WA (US); Robert Bedient, Oregon City, OR (US)

(73) Assignee: Carlisle Interconnect Technologies, Inc., St. Augustine, FL (US)

( * ) Notice: Subject to any disclaimer, the term of this patent is extended or adjusted under 35 U.S.C. 154(b) by 0 days.

(21) Appl. No.: 15/697,017

(22) Filed: Sep. 6, 2017

(51) Int. Cl.
*H01R 24/40* (2011.01)
*H01R 13/02* (2006.01)
*H01R 101/00* (2006.01)

(52) U.S. Cl.
CPC ..... *H01R 24/40* (2013.01); *H01R 13/02* (2013.01); *H01R 2101/00* (2013.01)

(58) Field of Classification Search
CPC ..... H01R 24/40; H01R 13/66; H01R 13/658; H01R 24/38; H01R 23/26
USPC ..... 439/817, 578–594, 66, 824, 700
See application file for complete search history.

(56) References Cited

U.S. PATENT DOCUMENTS 3,275,970 A 9/1966 Bengt et al.
3,416,125 A 12/1968 Theve
4,740,746 A 4/1988 Pollock et al.
4,789,351 A * 12/1988 Fisher, Jr. ..... H01R 13/6315 439/248
5,329,262 A * 7/1994 Fisher, Jr. ..... H01R 13/6315 333/260
5,746,619 A * 5/1998 Harting ..... H01R 24/40 439/352
6,053,777 A 4/2000 Boyle
6,776,668 B1 8/2004 Scyoc et al.
7,077,697 B2 * 7/2006 Kooiman ..... H01R 9/0527 439/247
7,416,418 B2 8/2008 Berthet et al.
7,922,529 B1 4/2011 Meurer
7,972,173 B1 * 7/2011 Hyzin ..... H01R 13/2421 439/578
8,460,010 B2 * 6/2013 Kimura ..... G01R 1/06722 439/66

(Continued)

FOREIGN PATENT DOCUMENTS

FR 2462797 2/1981

*Primary Examiner* — Harshad C Patel
(74) *Attorney, Agent, or Firm* — Wood Herron & Evans LLP

(57) ABSTRACT

A coaxial connector includes a body element that has an inner bore configured for receiving a cable having inner and outer conductors. A center conductor element is configured for engaging an inner conductor of the cable. A tubular ground slide extends over the center conductor element and has a front end and rear end with the rear end of the slide engaging the body element for being axially movable on the f the body element. A spring is configured to engage an outer surface of the body element and abut the rear end of the ground slide for biasing the ground slide with respect to the body element. A conductive sleeve has a rear end configured for press fitting onto the body. The sleeve is further configured for capturing the spring and ground slide with the body element and has a plurality of spring fingers at a front end thereof that contact the front end of the movable ground slide for providing electrical connection with the body element.

18 Claims, 6 Drawing Sheets

(56) References Cited

U.S. PATENT DOCUMENTS

| | | | | |
|---|---|---|---|---|
| 8,888,527 | B2 * | 11/2014 | Chastain | H01R 24/542<br>439/578 |
| 2003/0082942 | A1 * | 5/2003 | Wlos | H01R 13/6276<br>439/348 |
| 2010/0267291 | A1 * | 10/2010 | Chabineau-Lovgren | H01R 13/2421<br>439/817 |
| 2014/0322969 | A1 * | 10/2014 | Palinkas | H01R 9/0527<br>439/578 |

* cited by examiner

INLINE COMPRESSION RF CONNECTOR

FIELD OF THE INVENTION

This invention relates generally to cables and connectors for handling electrical and data signals and specifically to a connector having compressible conductor components.

BACKGROUND OF THE INVENTION

RF cables and associated connectors are used for a variety of different applications including testing and data signal transmission. Such applications may require the connector to interface with circuit board signal traces and/or other mating connectors. Furthermore, various applications may include a high density of connectors at the connection plane for the electrical connections that must be made between, for example, electronic power supplies, sensors, activators, circuit boards, bus wiring, wiring harnesses, and other elements to provide the electrical pathways needed to transport electricity in the form of control signals and power signals. The signal integrity and reliability requirements for operating in certain environments and applications are stringent, and therefore, it is important to have superior ground and signal isolation. This is particularly so with high frequency RF applications. Also, such connectors and contacts therein must work in a wide frequency range and wide variety of environmental conditions such as mechanical, vibration, wide temperature ranges, etc.

While various solutions have been proposed, they are often complicated, require a large number or parts, and are thus expensive. Furthermore, certain solutions are limited in their application and how they might be packaged and so may only be able to mate with other connectors, or only within a circuit board scenario. As such, they are limited in the signal applications they can support and might be dedicated to only RF signal or only power signal application. Still further, existing solutions often cannot handle a wide tolerance variation at the signal mating interface.

Examples of contacts that implement compressible components also fall short as the spring components used for providing 360-degree grounding are often inconsistent. Those connectors that implement compressible or spring biased ground elements will incorporate the actual spring element into the ground path and therefore introduce impedance variations as the spring flexes. Other designs use compressible interposer components to address tolerance issues and have elastomeric layers with conductive elements therein. Such designs require significant clamping forces for proper usage and can still introduce inconsistency in the ground signal integrity.

Thus, it is desirable to provide an inline connector for RF signal handling that provides a consistent ground signal integrity as well as a 360-degree ground. It is further desirable to provide such a connector that is scalable and may be packaged and used for hybrid RF and power connectors. It is also desirable for a connector design that operated to support board to board, cable to board and cable to cable applications while handling and managing wide tolerance variations.

SUMMARY OF THE INVENTION

A coaxial connector includes a body element that has an inner bore configured for receiving a cable with inner and outer conductors. A spring-biased center conductor element is configured for engaging the inner conductor of a cable. A tubular ground slide is configured for extending over the center conductor element, wherein the rear end of the slide engages the body element for being axially movable on the body element. A spring is configured to engage an outer surface of the body element and is positioned to abut the ground slide for biasing the ground slide with respect to the body element. A conductive sleeve is press fit onto the body and the sleeve captures the spring and ground slide with the body element. The conductive sleeve includes a plurality of spring fingers at a front end thereof that are configured for contacting the front end of the movable ground slide for providing electrical connection with the body element at a front end of the connector.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serves to explain the invention.

DETAILED DESCRIPTION OF EMBODIMENTS OF THE INVENTION

The present invention addresses various needs in the prior art and improves upon the general prior art by providing an RF connector that provides inline compression of both a spring-biased center conductor element and a spring-biased ground slide that is electrically reflective of a ground signal provided by an outer conductor of a cable. The independently spring-biased center conductor element and ground slide convey signals directly to a conductive pattern or signal traces on a printed circuit board or to corresponding elements of another mating cable connector. Such inline connectors can be used individually and may also be packaged into high density custom layouts or into commonly available industry connector platforms. Although the connector and cable described herein is suitable for RF signals and particularly high frequency RF signals.

Figure 1:
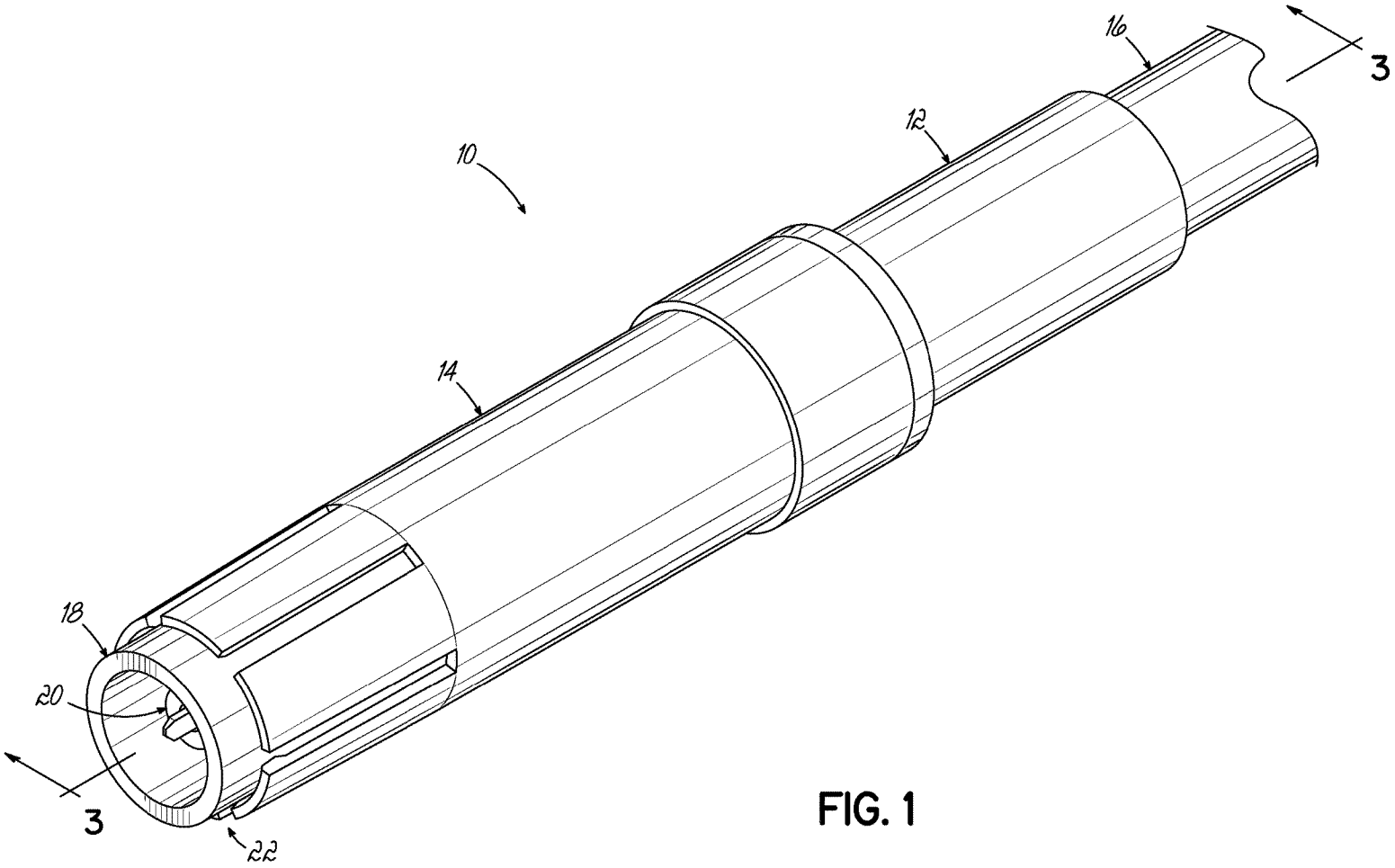
FIG. 1 is a perspective view of a connector in accordance with one embodiment of the invention.

Turning to FIG. 1, the connector 10 in accordance with one embodiment of the invention is illustrated. The connector 10 includes a body element 12 that is configured for receiving a cable 16. The body element is made of a suitably robust metal material such as beryllium copper, nickel silver, bronze, for example. Generally, the cable will be a coaxial cable having an inner conductor and an outer conductor. The body element receives the cable and exposed inner and outer conductors 50,54 and electrically couples with the cable as described herein to present the signals of the conductors, including the ground signal, at the end of the connector. The inner conductor 50 interfaces with a spring-biased center conductor element 20 of the connector while the outer conductor of the cable electrically interfaces with body element 12 and spring-biased ground slide 18. As illustrated in FIG. 1, the center conductor element 20 and ground slide 18 are presented at the tip end of the connector 10 for engagement with a suitable conductive pattern or other connector. Both the center conductor element 20 and ground slide 18 are compressible in accordance with one feature of the invention.

Figure 3:
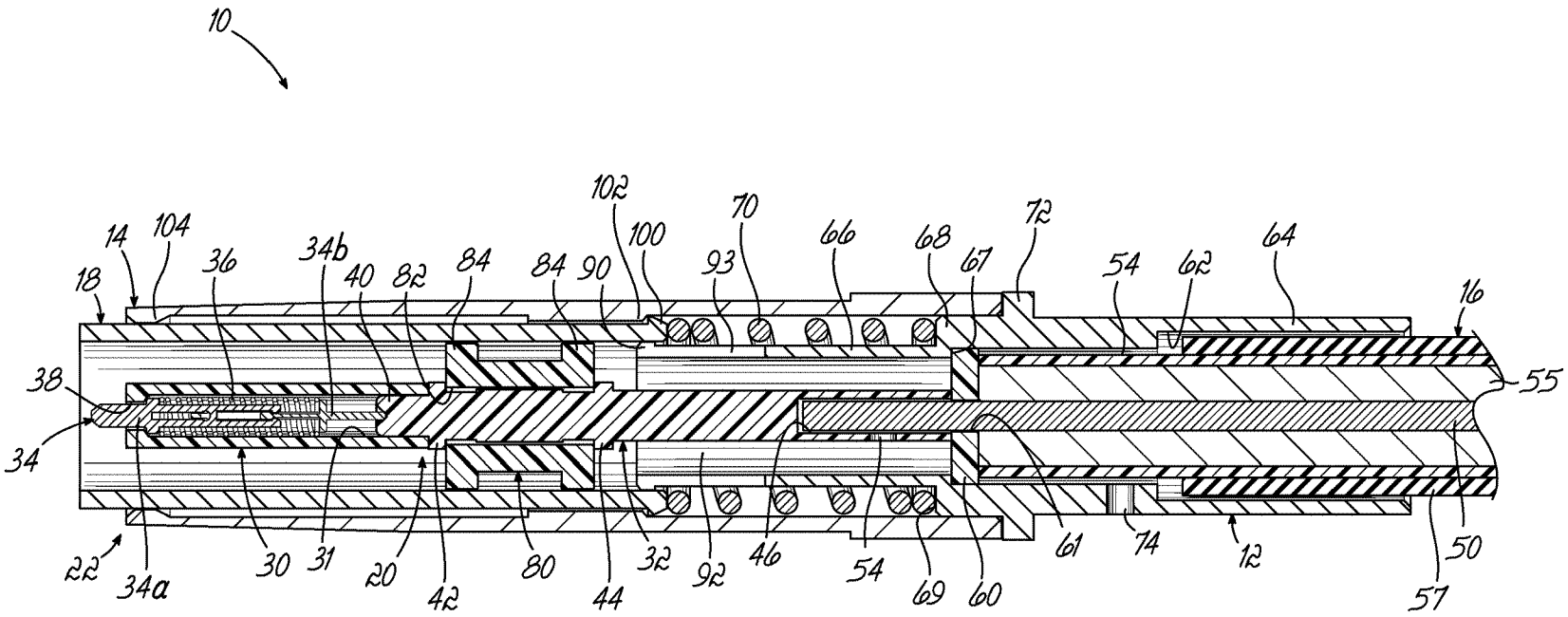
FIG. 3 is a side view, in partial cross-section, of a connector in accordance with the embodiment of the invention shown in FIG. 1.

Turning to FIGS. 1 and 3, the conductive sleeve 14 covers the ground slide and center conductor element and interfaces with an end of the body element 12 as discussed herein. In accordance with one feature of the invention, the conductive sleeve provides an electrical contact with the ground slide 18 out at the tip end 22 of the connector and thus provides a ground signal very close to the end of the connector. This provides a more robust ground signal or outer conductor of the cable. Furthermore, to address shortcomings in the prior art, the conductive sleeve eliminates a ground path that passes through the spring element that is biasing the ground slide 18, as illustrated. The disclosed embodiment may be sized appropriately to accept multiple sizes and constructions of cables including semi-rigid, conformable and flexible RG style cable. Therefore, cable 16 and its construction is not limiting. Furthermore, the specific dimensions and tubular shapes of the components are not liming to the invention. For example, the invention might be use for 0.034-0.141 size cable. As such diameters and outer dimensions and other dimensions of the body element, ground slide, and sleeve might be adapted for a particular size cable and application. Also, depending upon the frequency response and impedance desired, the shape and location of the center support element as discussed herein as well as the tip shapes of the end shapes of the ground slide and sleeve might be varied to achieve desirable frequency responses and impedance values for the cable.

Figure 2A:
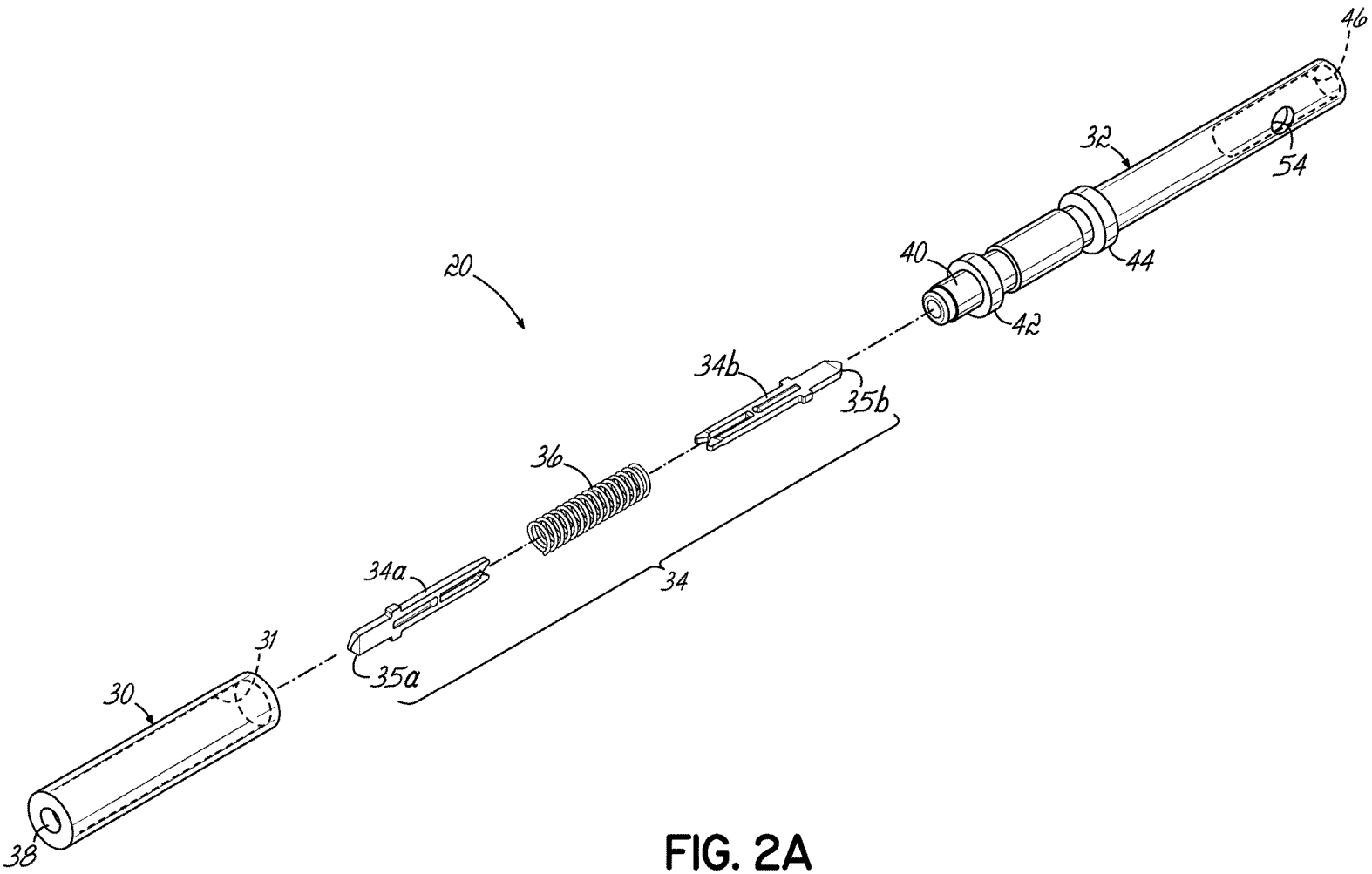
FIG. 2A is an exploded view of elements of a connector in accordance with the embodiment of the invention shown in FIG. 1.
Figure 2B:
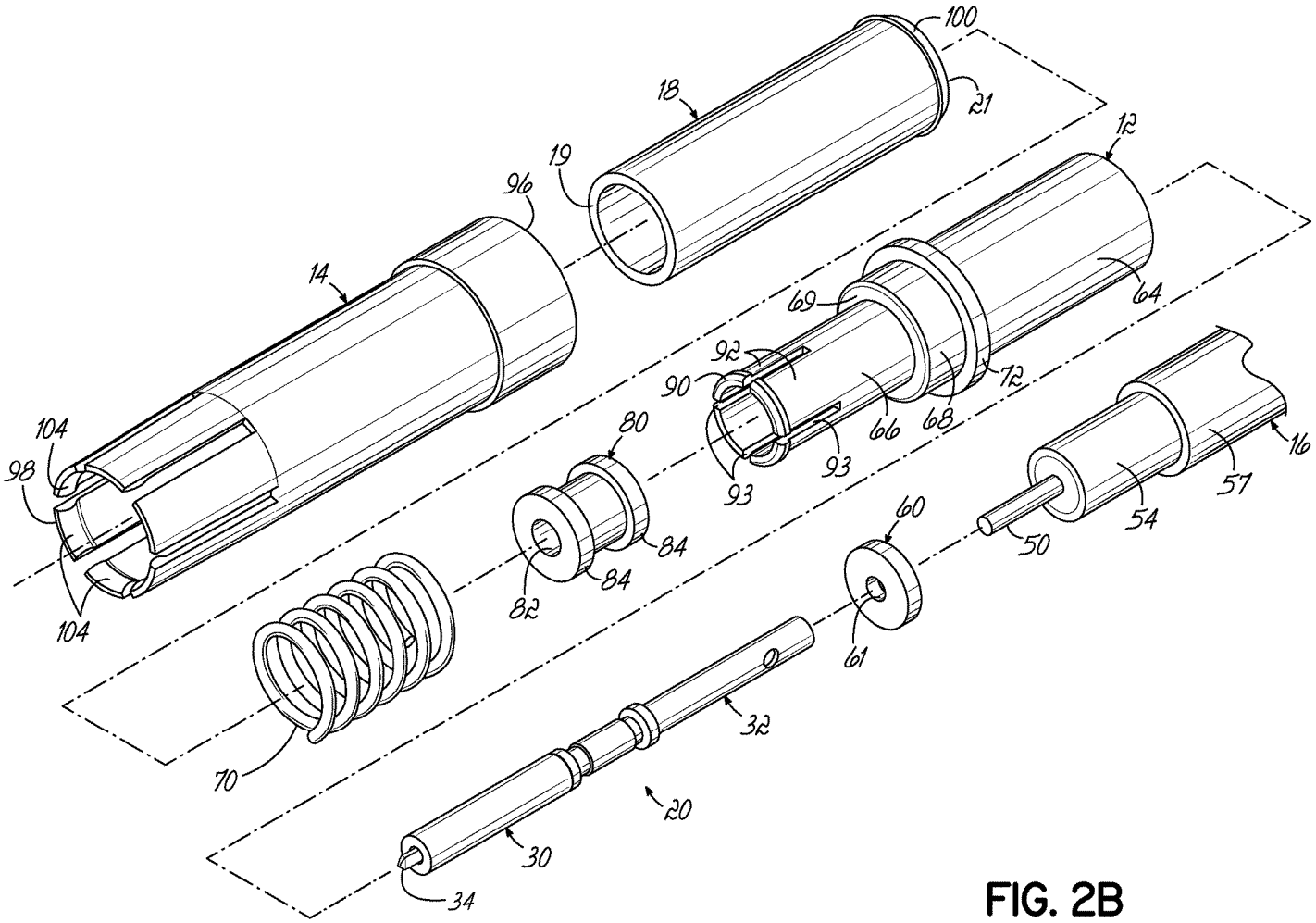
FIG. 2B is an exploded view of other elements of a connector in accordance with the embodiment of the invention shown in FIG. 1

FIGS. 2A and 2B illustrate exploded views of various components and elements of connector 10 as incorporated in the illustrated embodiment. More specifically, FIG. 2A illustrates components forming a center conductor element 20 of the invention and includes a front portion 30 and a rear portion 32 that are configured to fit together and form a unitary element. The portions 30, 32 come together to contain a spring-biased or spring-loaded pin element 34. Such spring-biased pins are commercially available, such as H-pins from Plastronics of Irving, Tex. USA. The pin may be made of a suitably conductive material such as beryllium copper. In one embodiment, the spring-biased pin 34 might include two interacting halves 34*a*, 34*b* which slide together and apart and capture a spring 36 therebetween to thus provide a spring bias to each of the opposing ends 35*a*, 35*b* of the spring-biased pin 34. As illustrated in FIG. 2A, and also in the cross-sectional view of FIG. 3, the spring-biased pin 34 fits into front portion 30 which has a bore 31 formed therein. The tip 35*a* is exposed through an appropriate aperture 38 formed in the front portion. The end 40 of the rear portion 32 engages with the other pin tip 35B and also fits into a receiving end of the bore of the front portion 30 to thereby seal the bore and contain the spring-biased pin 34. Tip 35*b* and the engagement with the rear portion 32 also provides an electrical connection for the center conductor element 20. Shoulders 42, 44 are formed on the rear portion 32 of the center conductor element and shoulder 42 abuts against the end of the front portion 30 to seal bore 31 and contain pin 34.

The rear portion 32, as illustrated in FIGS. 2A, 3, also includes a hollow bore 46 to receive and engage with the inner conductor 50 of cable 16. In one embodiment, the inner conductor or wire 50 of cable 16 may be inserted into the bore 46 and soldered, such as through an appropriate aperture 54 which provides flow access for the solder to the bore 46. In that way, the center conductor element 20 is electrically connected with the inner conductor of the cable 16 and the signal is presented at the pin tip 35*a* of the spring biased pin 34. Cable 16 also includes an outer conductor 54 as illustrated in FIG. 3 that couples with body element 12 of the connector 10 as discussed herein. The engagement between the end 40 of rear portion 30 and bore 31 of the front portion 30 is by a press fit in the disclosed embodiment but other means of coupling might be used as well. For forming the center conductor element 20, the spring biased pin 34 is dropped into front portion 30 which is then press fit to the rear portion 32 to provide a unitary center conductor element as illustrated in FIG. 3.

Turning now to FIG. 2B, other elements of the connector of the invention are shown in an exploded view. Cable 16 is illustrated with the inner conductor 50 and outer conductor 54 exposed. Generally, there is a suitable dielectric material 55 separating the inner and outer conductors 50, 54. Furthermore, an insulated jacket 57 might cover the outer conductor 54. The configuration of the illustrated coaxial cable utilized with connector 20 is not limiting to the invention. For securing cable 16 with center conductor element 20 and to provide insulation at the interface of the end of cable 16 with center conductor element 20, an insulative disc element 60 having a center bore 61 for receiving inner conductor 50 is installed over the inner conductor before the inner conductor is inserted into center conductor element and soldered to center conductor element 20 of the connector 10. Disc element 60 is formed of a suitable insulative material, such as a dielectric material. As illustrated in FIG. 3, the disc element provides a stop structure with respect to cable 16 and its engagement in the bore 62 of the body element 12.

Body element 12 includes an inner bore 62 configured for receiving cable 16. The body element 12 includes a rear portion 64 that transitions to a front portion 66 through a transition portion 68. Generally, the body element tapers downwardly in diameter between the rear portion 64 which is configured for engaging or receiving cable 16 and front portion 66 over which a spring 70 must slide, as discussed herein. Body element 12 also includes an annular ring 72 which extends radially outwardly from the surface of the body element rear portion 64 and provides a stop structure for the conductive sleeve 14 which is press fit onto body element 12. The transition portion 68 also provides an external shoulder 69 against which spring 70 is biased in the construction of the connector 10.

Turning now to FIG. 2B, once center conductor element 20 is secured with cable 16 and with insulated disc element 60, the center conductor element 20 can then be coupled with body element 12. The transition portion 68 also provides an inner shoulder 67 against which the disc element 60 is positioned. Once cable 16 is positioned in the body element 12 with the center conductor element 20, the cable assembly may be secured in the rear portion 64 of the body element 12, such as by soldering. Solder may flow through aperture 74 to engage with the outer conductor 54 of cable 16 and thereby provide an electrical connection between body element 12 and the cable 16. The signal of the outer conductor 54, such as a ground signal, is thus provided to the body element 12 of the connector 10. Generally, before soldering or are otherwise more permanently connecting the cable with body element 12, the position of the end of the cable and disc element 60 should be determined to make sure it is in the right position.

Referring to FIG. 3, with the cable 16 and center conductor element 20 secured with body 12, the center conductor element extends through the bore 62 of the body element and exits the bore to be presented at the tip end 22 of the connector 10. For proper impedance between the center conductor 70 and ground slide 18 of the connector, an insulative element, such as an insulative center support 80 is positioned over the center conductor element 20. The center support 80 is press fit onto the center conductor element 20, and specifically may be press fit to rest between annular elements 42 and 44 on the center conductor element (see FIG. 2A). Center conductor element 25 fits through a bore 82 in the center support 80. An outside surface, such as surfaces provided by outer rim elements 84 engage the inside surface of the tubular ground slide 18 and thus properly position or center the center conductor element 20 within the ground slide 18 of the connector. As illustrated in FIG. 3, the front portion 30 and spring-biased pin 34 of the center conductor element 20 are suspended and centered within the ground slide.

Referring again to FIG. 3, for constructing connector 10, once the cable and center conductor element have been secured with body element 12, spring 70 may be installed onto the housing. Specifically, the spring is configured and dimensioned to engage in outer surface of the front portion 66 of the body element and to ultimately abut with shoulder 69 on the body element and the rear end of the ground slide 18 in order to bias the ground slide with respect to the body element. More specifically, spring 70 fits over the front portion 66 of the body element 12 and abuts against shoulder 69 formed by the transition portion 68 that transitions between the rear portion 64 of the body element and the front portion 66. Then, the ground slide 18, which is generally a tubular element extends over the center conductor element to engage with the body element 12. Specifically, the ground slide 18 has a front end 19 and a rear end 21 and may be formed of a suitable material, such as beryllium copper. For conductivity, the ground slide might also be coated with a conductive coating, such as 10-20 microns of gold. The rear end 21 of the ground sliding engages with a portion of the body element and specifically with the front portion 66 of the body element as illustrated in FIG. 3 in order to slide on the body element 12 and be biased by spring 70.

In the illustrated embodiment of the invention the front portion 66 of the body element includes a flared portion 90 in the form of an annular ridge that extends radially outwardly from the end of the body element front portion 66. More specifically, as illustrated in FIG. 2B, front portion 66 includes a plurality of spring fingers 92 and the annular ridge is formed collectively by flared ends of the spring fingers. Individual fingers may be formed by slots 93 formed within the front portion 66. In that way, spring fingers 92 direct or bias the annular ridge 90 against the inside surface of ground slide 18 as illustrated in FIG. 3 for providing an electrical contact between body element 12 and the ground slide 18 proximate the annular ridge 90. Spring fingers 92 allow the ground slide to more readily slide on front portion 66 of the body element during connection with the printed circuit board or another connector and the subsequent compression of the ground slide 18 and spring 70.

Once spring 70 and ground slide 18 are installed on or engaged with the body element 12, conductive sleeve 14 is inserted over the ground slide 18, spring 70, and the front portion 66 of the body element. More specifically, a rear end 96 of the conductive sleeve is press fit onto the transition portion 68 of the body element and is appropriately dimensioned and configured for a secure press fit. The rear end 96 of the conductive sleeve abuts against shoulder 72 of the body element. The inside surface of the conductive sleeve 14 includes features for engaging with and capturing the ground slide 18. More specifically, referring to FIGS. 2B and 3, the ground slide includes an annular ridge 100 that extends radially outwardly from the rear end 21 of the ground slide. The conductive sleeve, on the other hand, includes an internal shoulder 102 that extends radially inwardly. When the conductor sleeve is press fit onto the body element, the inwardly extending shoulder engages the outwardly extending annular ridge for securing the ground slide in the connector and limiting its travel under the bias of spring 70. That is, the cooperating elements of the conductive sleeve and ground slide prevent the conductive sleeve from being pulled out of the ground slide and the connector while still allowing the ground slide to compress inwardly against spring 70. The conductive sleeve may also be formed of a conductive material such as beryllium copper. Generally, the conductive sleeve is dimension in length such that when the ground slide 18 and inner conductor 20 are compressed fully within the connector, they are generally coplanar with the front end 98 of the conductive sleeve. The spring may be formed of a suitable material, such as beryllium copper or stainless steel, for example, that all may be covered with a precious metal coating for conductivity, and is configured to provide a force on the fully compressed spring typically in the range of 60 to 90 grams of compression force per linear inch.

In accordance with one feature of the present invention, the conductive sleeve provides electrical contact with ground slide 18 out at the tip end 22 of the connector. This provides an immediate ground signal path to the ground slide. Furthermore, that feature of the invention, avoids the use of the spring 70 as part of the ground signal path. More specifically, referring to FIGS. 2B and 3 the front end 98 of the conductive sleeve 14 includes a plurality of spring fingers that are configured for contacting the front end of the ground slide as illustrated in FIG. 3. Each of the spring fingers includes an inwardly extending annular projection 104 and thus provides multiple contact points with the ground slide proximate to the front end 19 of the ground slide and the front end of the connector. The contact provides a ground signal path through the conductive sleeve and directly to the body element 12 and spring 70 does not form part of the ground signal path. Furthermore, the spring fingers and annular projections 104 essentially extend for 360° around the ground slide thus providing essentially 360° of the grounding signal or other outer conductor signal at the tip of the connector. Because the spring is not involved in the ground path, consistent impedance is provided, even when the spring is flexing upon compression of the ground slide. For maintaining proper impedance between the center conductor element and ground slide, the material and dimensions of the center support 80 is selected. In one embodiment of the invention, the center support is made of a suitable dielectric material for example, PTFE, FEP, TPX, PEEK, Delrin, Ultem, etc. Preferably, the combination of components and their orientation is set forth in the illustrated invention provides a 50 ohm impedance in the cable. The independent spring bias of each the center conductor element and ground slide provide for greater flexibility with respect to meeting with and addressing any tolerance issues of the printed circuit board or other cable connector. Such an inline RF connector as illustrated and disclosed herein can be packaged in a number of custom layouts or into known industry connector formats. The mounting or mating plane of the connector is defined by the front end of the conductive sleeve as the spring-biased pin and ground slide will compress back to the end of the rigid sleeve. In one embodiment of the invention, the spring-biased center conductor may extend out of the mounting plane of the connector in the range of 0.010-0.030 inches with a minimum of 0.010 inch and will compress accordingly when mounted. The ground slide, on the other hand, may extend out of the mounting plane 0.020-0.030 inches.

Figure 4A:
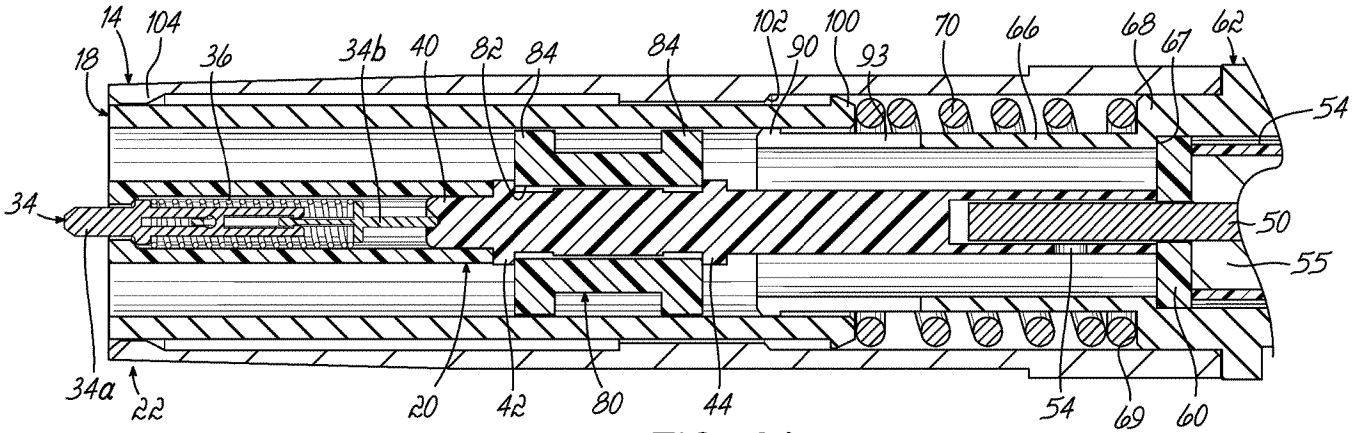
FIG. 4A is a side view, in partial cross-section, of a connector in accordance with the embodiment of the invention shown in FIG. 1.
Figure 4B:
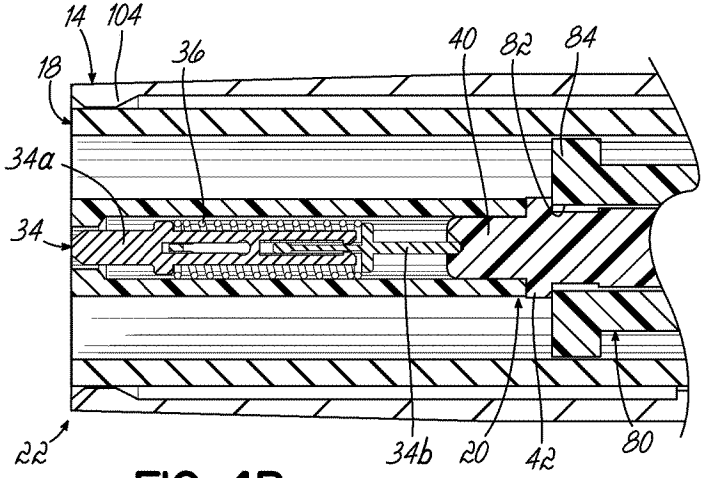
FIG. 4B is a side view, in partial cross-section, of a connector in accordance with the embodiment of the invention shown in FIG. 1.

Referring to FIGS. 4A and 4B, FIG. 4A illustrates compression of the ground slide 18, thus compression of spring 70 such as when the connector is used to mate with printed circuit board or other connector. FIG. 4B illustrates compression of both the ground slide as well as the center conductor element to provide for essentially a flat face or mating surface at the end 22 of the connector with both conductive components compressed.

Figure 5:
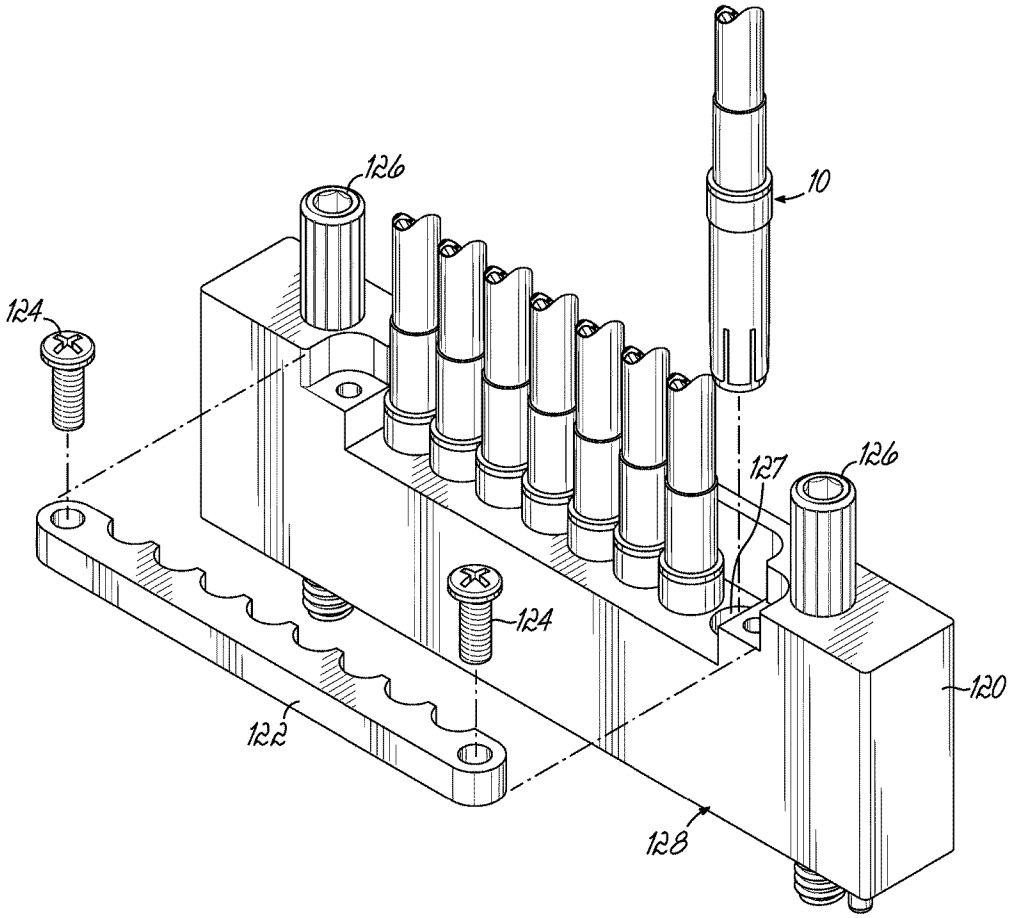
FIG. 5 is a perspective view of a connector assembly utilizing the connector in accordance with the embodiment of the invention shown in FIG. 1.

FIG. 5 illustrates an RF connector 10 in accordance with the invention incorporated within a larger, high density connector format wherein multiple connectors 10 are incorporated within a connector body 120 in a high-density array. FIG. 5 illustrates a connector with one row of inventive connectors 10. It will be appreciated that in an array of X by Y connectors might also be formed using the invention. Generally, the ends of the individual connectors 10 might be positioned in the bores 127 formed in the body 120 and then secured within body 120 by appropriate clamp elements 122 and fasteners 124. Other retaining elements, such as clips might also be used to secure the cables into a connector body such as body 120. The connectors and bores would be configured so the ends 22 of the connectors are generally positioned in a co-planar fashion at the face 128 of the body 120 so that the center conductor element and ground slide project past the face 128 to be appropriately compressed when mated with a circuit board or other connector. The block body 120 may then be secured, such as to a circuit board or other connector, utilizing fasteners 126. As noted, the connector system as illustrated in FIG. 5 is not limiting with respect to the invention, and a greater or lesser number of individual connectors 10 might be incorporated into an array as shown in FIG. 5. Also, the body 120 may have any appropriate shape as necessary for implementing the invention into a particular application.

While the present invention has been illustrated by the description of the embodiments thereof, and while the embodiments have been described in considerable detail, it is not the intention of the Applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of Applicant's general inventive concept.

What is claimed is:

1. A coaxial connector comprising:

a body element having an inner bore configured for receiving a cable having inner and outer conductors;

a center conductor element configured for engaging an inner conductor of the cable received by the body element;

a tubular ground slide configured for extending over the center conductor element and having a front end and rear end, the rear end of the slide engaging a portion of the body element for being axially movable on the portion of the body element;

a spring configured to engage an outer surface of the body element and positioned to abut the rear end of the ground slide for biasing the ground slide with respect to the body element;

a conductive sleeve having a rear end configured for press fitting onto the body, the sleeve further configured for capturing the spring and ground slide with the body element;

the conductive sleeve including a plurality of spring fingers at a front end thereof that are configured for contacting the front end of the movable ground slide for providing electrical connection with the body element at a front end of the connector.

2. The coaxial connector of claim 1, wherein the center conductor element is spring-biased in the connector.

3. The coaxial connector of claim 1, further comprising an insulative center support positioned in the ground slide, the center conductor element extending through the center support for centering the center conductor element in the ground slide.

4. The coaxial connector of claim 1, wherein the rear end of the ground slide includes an annular ridge extending radially outwardly from the ground slide, the conductive sleeve including a shoulder extending radially inwardly and engaging the annular ridge for securing the ground slide in the connector.

5. The coaxial connector of claim 1, wherein the portion of the body element engaged with the ground slide includes an annular ridge extending radially outwardly from the body portion for providing electrical connection between the ground slide and body element.

6. The coaxial connector of claim 5, wherein the portion of the body engaged with the ground slide includes a plurality of spring fingers flexing radially outwardly with respect to the body element.

7. The coaxial connector of claim 6, wherein the spring fingers form the annular ridge.

8. The coaxial connector of claim 1, wherein the center conductor element includes a bore for receiving an inner conductor of the cable and further comprising an insulative disk element surrounding the bore and including a center opening configured for receiving the cable inner conductor.

9. The coaxial connector of claim 2, wherein the center conductor element includes a front portion and a rear portion that are configured for capturing a spring biased pin therein to form the spring-biased center conductor element.

10. A coaxial cable assembly comprising:

a cable having an inner conductor and outer conductor;

a connector body element having an inner bore configured for receiving the cable inner and outer conductors, the outer conductor electrically coupled with the connector body element;

a center conductor element configured for engaging the inner conductor;

a tubular ground slide configured for extending over the center conductor element and having a front end and rear end, the rear end of the slide engaging a portion of the connector body element for being axially movable on the portion of the body element;

a spring configured to engage an outer surface of the connector body element and positioned to abut the rear end of the ground slide for biasing the ground slide with respect to the connector body element;

a conductive sleeve having a rear end configured for press fitting onto the connector body element, the sleeve further configured for capturing the spring and ground slide with the connector body element;

the conductive sleeve including a plurality of spring fingers at a front end thereof that are configured for contacting the front end of the movable ground slide for providing electrical connection with the connector body element at a front end of the connector body element.

11. The coaxial cable assembly of claim 10, wherein the center conductor element is spring-biased in the connector body element.

12. The coaxial cable assembly of claim 10, further comprising an insulative center support positioned in the ground slide, the center conductor element extending through the center support for centering the center conductor element in the ground slide.

13. The coaxial cable assembly of claim 10, wherein the rear end of the ground slide includes an annular ridge extending radially outwardly from the ground slide, the conductive sleeve including a shoulder extending radially inwardly and engaging the annular ridge for securing the ground slide in the connector body element.

14. The coaxial cable assembly of claim 10, wherein the portion of the connector body element engaged with the ground slide includes an annular ridge extending radially outwardly from the body portion for providing electrical connection between the ground slide and connector body element.

15. The coaxial cable assembly of claim 14, wherein the portion of the body engaged with the ground slide includes a plurality of spring fingers flexing radially outwardly with respect to the body element.

16. The coaxial cable assembly of claim 15, wherein the spring fingers form the annular ridge.

17. The coaxial cable assembly of claim 10, wherein the center conductor element includes a bore for receiving the inner conductor of the cable and further comprising an insulative disk element surrounding the bore and including a center opening configured for receiving the cable inner conductor.

18. The coaxial cable assembly of claim 11, wherein the center conductor element includes a front portion and a rear portion that are configured for capturing a spring biased pin therein to form the spring-biased center conductor element.

* * * * *